US006375345B1

(12) United States Patent
Lepez et al.

(10) Patent No.: US 6,375,345 B1
(45) Date of Patent: Apr. 23, 2002

(54) HEATING WORM CONVEYOR

(75) Inventors: Olivier Lepez, Viarmes; Philippe Sajet, Lacroix St-Ouen, both of (FR)

(73) Assignee: E.T.T.A. Evaluation Technologique Ingenierie et Applications, Compiegne (FR)

( * ) Notice: Subject to any disclaimer, the term of this patent is extended or adjusted under 35 U.S.C. 154(b) by 0 days.

(21) Appl. No.: 09/582,214

(22) PCT Filed: Jan. 29, 1999

(86) PCT No.: PCT/FR99/00188

§ 371 Date: Jul. 19, 2000

§ 102(e) Date: Jul. 19, 2000

(87) PCT Pub. No.: WO99/39549

PCT Pub. Date: Aug. 5, 1999

(30) Foreign Application Priority Data

Jan. 30, 1998 (FR) ..... 98 01046

(51) Int. Cl.[7] ..... B01F 7/08; B01F 15/06

(52) U.S. Cl. ..... 366/144; 366/146; 366/320; 366/318; 219/209

(58) Field of Search ..... 366/144, 146, 366/79, 318, 320; 99/348, 358; 219/209, 244, 254, 256, 523; 416/95

(56) References Cited

U.S. PATENT DOCUMENTS

| | | | | | |
|---|---|---|---|---|---|
| 2,690,890 | A | * | 10/1954 | Weeks et al. | 416/95 |
| 3,109,913 | A | * | 11/1963 | Galajda, Jr. | 366/146 |
| 3,589,834 | A | | 6/1971 | Cairelli | 366/342 |
| 3,900,188 | A | * | 8/1975 | Seufert | 366/318 |
| 4,090,054 | A | * | 5/1978 | Heine et al. | 219/421 |
| 4,678,881 | A | * | 7/1987 | Griffith | 366/146 |
| 4,900,158 | A | * | 2/1990 | Ugolini | 366/320 |
| 5,135,355 | A | * | 8/1992 | Colley et al. | 366/147 |
| 5,417,492 | A | | 5/1995 | Christian et al. | 366/146 |
| 5,455,402 | A | * | 10/1995 | Griffith | 219/630 |
| 5,547,277 | A | | 8/1996 | Caspelherr et al. | 366/146 |
| 5,876,117 | A | * | 3/1999 | Chen | 366/320 |
| 6,030,112 | A | * | 2/2000 | Milek | 366/320 |

FOREIGN PATENT DOCUMENTS

| | | |
|---|---|---|
| DE | 563 690 | * 11/1932 |
| FR | 2 009 332 | * 1/1970 |
| GB | 2 175 815 | * 12/1986 |
| JP | 62-234534 | * 10/1987 |

OTHER PUBLICATIONS

International Search Report of PCT/FR99/00188, Jun. 4, 1999.

* cited by examiner

*Primary Examiner*—Tony G. Soohoo
(74) *Attorney, Agent, or Firm*—Nixon Peabody LLP; Stuart J. Friedman

(57) ABSTRACT

Apparatus for transferring and heat-treating divided solids comprises at least one transfer member (2) having a longitudinal axis (3) and a helical portion (4) mounted to rotate about its own longitudinal axis in a tubular case (1) and connected to the outlet shaft of a rotary drive motor (12). At least the helical portion (4) of the transfer member (2) is made in its bulk of an electrically conductive material, and the transfer member (2) has means (11) for connecting it to an electricity power supply so as to constitute heater means.

10 Claims, 2 Drawing Sheets

HEATING WORM CONVEYOR

FIELD OF THE INVENTION

The present invention relates to apparatus for transferring and heat-treating divided solids such as powder materials.

BACKGROUND OF THE INVENTION

Apparatuses presently in use in industry for transfer and heat-treatment purposes comprise a transfer member and heat-treatment heater means.

In a first type of apparatus, the transfer member is a vibrating tubular case receiving the divided solids. The heat-treatment is then provided by heating the tubular case. Such apparatuses are difficult to implement and are relatively expensive.

A second type of apparatus is known in which the transfer member is a screw mounted to rotate about a longitudinal axis inside a tubular case. The heater means is constituted either by the case (which then constitutes a double wall for circulating a heat-conveying fluid), or by heating resistance elements fixed on the outside of the case, or by a tube around which the screw is wound, which tube conveys a fluid that is raised to a high temperature. Apparatuses of the above type are simpler to implement than the previously-mentioned apparatuses. Nevertheless, in the second type of apparatuses, only those solids which are close to the heating case or to the heating tube are subjected to an effective flow of heat. When a heating tube is used, it has also been found that since the tube does not perform any function associated with transferring or stirring the divided solids, the divided solids that are located in the vicinity of the tube are not renewed. As a result, the heating of the divided solids is incomplete, irregular, and not very effective. In order to heat particles located in positions that are remote from the tube, it becomes necessary to increase the temperature of the tube which runs the risk of turning the particles close to the tube into a crust because they are overheated, thereby disturbing flow and increasing maintenance costs (frequent cleaning is essential so as to remove particles sticking to the tube), or else the tubular case must also be heated, thereby further increasing the cost of the installation.

Finally, dual-case screws are known having an inner passage through which a heating fluid is passed. Nevertheless, that type of structure presents numerous drawbacks: in addition to the cost of high manufacturing costs and complex assembly for maintaining sealing while the screw is in rotation, thermal inertia becomes very high, thereby making it impossible to change temperature conditions quickly. This can be of great importance from a safety point of view in the event of a dangerous reaction occurring, in which case it is necessary to stop heating the substances being transferred as quickly as possible.

SUMMARY OF THE INVENTION

The object of the present invention is to remedy the above-specified drawbacks by designing apparatus which provides better performance.

According to the invention, this object is achieved by apparatus for transferring and heat-treating divided solids, the apparatus comprising at least one transfer member having a longitudinal axis and a helical portion mounted to rotate about its own longitudinal axis inside a tubular case and connected to the outlet shaft of a rotary drive motor, at least the helical portion of the transfer member being constituted in its bulk by an electrically conductive material, and the transfer member having connection means for connecting it to an electricity power supply so that it itself constitutes the heater means.

Thus, the heater means is constituted by the transfer member with which most of the divided solids are brought into contact while they are being transferred. All, or nearly all, of the divided solids are thus heated directly on coming into contact with the heater means, but without remaining stationary against the heating surface. The divided solids are thus heated in uniform manner and, in practice, the problems of crust formation are eliminated. In addition, the structure of the apparatus is simple, so its manufacturing cost remains low.

In a first embodiment, the helical portion of the transfer member comprises a helically-wound flat strip.

In a second embodiment, the helical portion is constituted by a helix wound around a shaft, the shaft then being made of an insulating material or being formed, at least on its outer surface, of an electrically conductive material.

Preferably, the electrically conductive material is a metal such as stainless steel.

Advantageously, the tubular case is constituted by an electrically insulating material. In this way, the risks of short circuits between the transfer element and the tubular case are eliminated, as are the risks of personnel being electrocuted by coming into contact with the tubular case. The safety of the apparatus is thus reinforced.

The tubular case is preferably covered at least in part by an internal friction lining of insulating material against which the helical portion bears. In this way, the friction lining supports the helical portion in such a manner as to prevent the helical portion from sagging while transferring solids. In addition, the friction lining isolates the helical portion electrically from the tubular case, which case can then be made of a conductive material. The risks of short circuits are then limited.

Also advantageously, the apparatus includes a coupling joint of electrically insulating material connecting the transfer member to the outlet shaft of the motor. The motor is thus insulated from the transfer member. The safety of the apparatus is thus further improved.

BRIEF DESCRIPTION OF THE DRAWINGS

Other characteristics and advantages of the invention will appear more clearly on reading the following description of particular, non-limiting embodiments of the invention. Reference is made to the accompanying drawings, in which.

DESCRIPTION OF THE PREFERRED EMBODIMENTS

Figure 1:
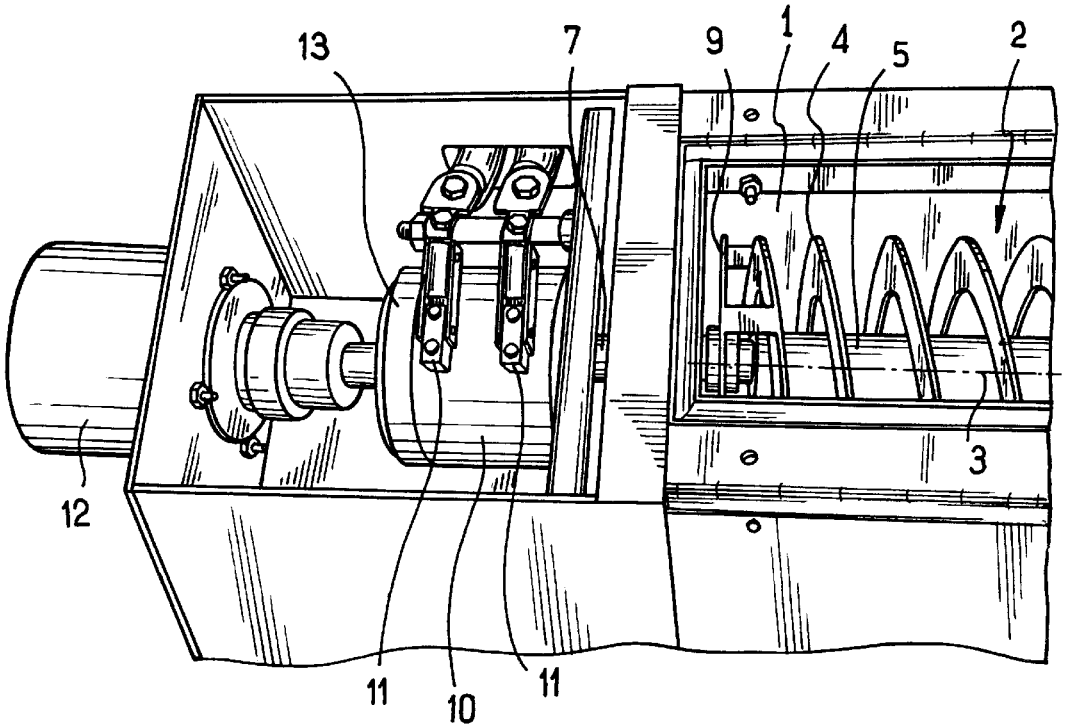
FIG. 1 is a fragmentary perspective view showing the drive motor end of transfer and heat-treatment apparatus constituting a first embodiment.
Figure 2:
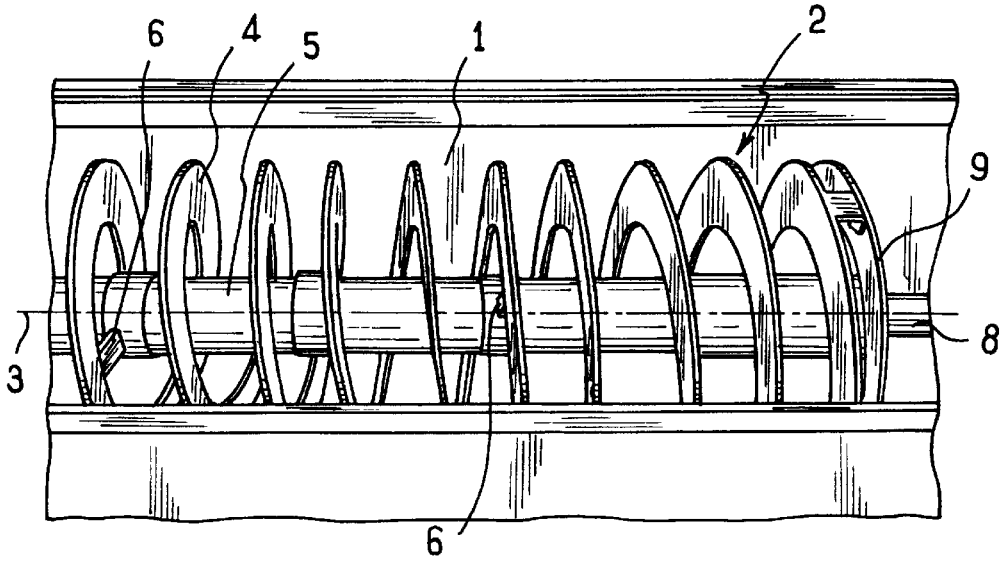
FIG. 2 is a view analogous to FIG. 1 showing the end opposite from the motor of the transfer member of the apparatus constituting the first embodiment.

With reference to FIGS. 1 and 2, the transfer and heat-treatment apparatus of the invention comprises an open-topped tubular case 1 including at respective ends an inlet duct and an outlet duct for the substance that is to be transferred (not shown herein). In this case, the tubular case 1 is made of an electrically insulating material such as a plastics material. Although the tubular case 1 is shown as being open-topped, it is equally possible for the tubular case 1 to be arranged in the form of a complete cylinder (covered).

A transfer member given overall reference 2 is mounted inside the tubular case 1 to rotate about its longitudinal axis 3.

The transfer member 2 has a helically-shaped portion 4 made from a flat strip, in this case of rectangular section, wound around a shaft 5 and held spaced apart therefrom by spacers 6 that are uniformly distributed along the shaft 5.

According to a characteristic of the first embodiment of the invention, the bulk of the helical portion 4 is made of an electrically conductive material, e.g. stainless steel.

In this case, the shaft 5 is electrically insulating and is mounted to rotate inside the tubular case 1 at two end portions 7 and 8 which are made of electrically conductive material and are received in bearings that are not shown in FIGS. 1 and 2. The helical portion 4 is electrically connected to the end portions 7 and 8 via plates 9 of electrically conductive material connected to the end portions 7 and 8.

The end portion 7 is associated with a drum 10 of electrically conductive material against which electricity-feeding carbon brushes 11 rub which are connected by conductor wires to an electricity power supply (not shown). The end portion 8 is likewise associated with a drum (not shown) of electrically conductive material against which there rub electricity-conveying carbon brushes. It will be understood that since the shaft 5 is made of electrically insulating material, the electricity is constrained to travel along the helical portion 4. Provision can also be made for the shaft 5 to be made out of an electrically conductive material but for it to be insulated from the end portions 7 and 8 and from the helical portion 4.

The power supply should be dimensioned as a function of the dimensional characteristics and the electrical resistance of the transfer member. Advantageously, the delivered AC or DC voltage is less than 100 volts for safety reasons. The means for connecting the power supply need not be carbon brushes, but could be slip rings, or non-carbon brushes rubbing against the outside surfaces of the drums, or indeed a rotary connection coupling mounted at one of the ends of the transfer member 2.

The drum 10 is connected to a rotary drive member 12 via a coupling joint 13. The coupling joint 13 is preferably made of insulating material. The coupling joint 13 can serve not only to provide insulation between the motor and the transfer member, but also to accommodate any misalignment between the outlet shaft and the end of the transfer member and/or to provide a resilient damping function.

It will be observed that the drum 10 and the assembly for coupling to the motor are received in an insulated compartment of the tubular case 1. This ensures good safety for the apparatus.

In operation, the transfer member 2 is rotated by the motor 12. Electricity conveyed from the power supply via the carbon brushes 11, the drum 10, the end portion 7, and the plate 9 is taken to the helical portion 4 of the transfer member 2 along which it flows, thereby heating it up by the Joule effect.

The divided solids for treatment are inserted into the tubular case 1 via an inlet duct (in this case at the motor end) and they are entrained by the helical portion 4 towards an outlet duct (at the opposite end). Simultaneously, the divided solids are heated all along their transfer by coming directly into contact with the outside surface of the helical portion 4. Because the helical portion 4 is rotating and because of the movement it induces in the divided solids, most of the divided solids are brought into contact with the heated helical portion during transfer. The heating of the divided solids is thus highly effective and uniform for all of the divided solids or nearly all of them.

There follows a description of second and third embodiments of the transfer and heat-treatment apparatus of the invention.

Elements that are identical or analogous to those described above are given the same numerical references in the description below.

Figure 3:
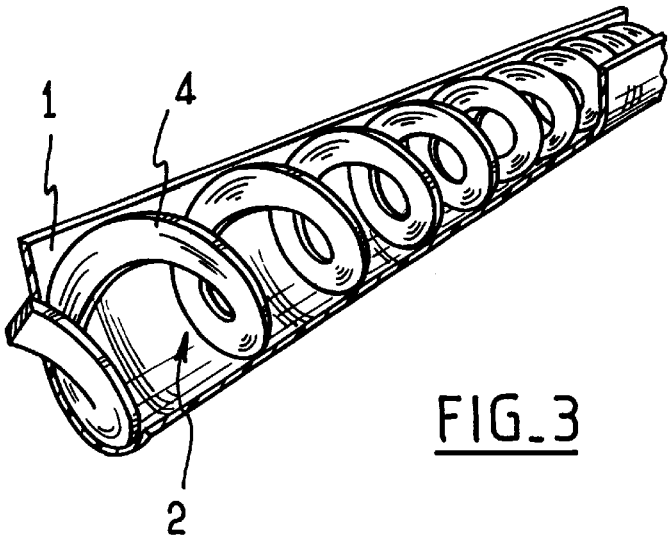
FIG. 3 is a partially cutaway fragmentary perspective view of transfer and heat treatment apparatus constituting a second embodiment.

In FIG. 3, there can be seen apparatus constituting a second embodiment.

The apparatus of the second embodiment is identical to the apparatus of the first embodiment as described above except in that the helical portion 4 is now self-supporting (no support shaft is provided). The structure of the transfer member is then particularly simple and is particularly well adapted to performing transfers over short distances.

Figure 4:
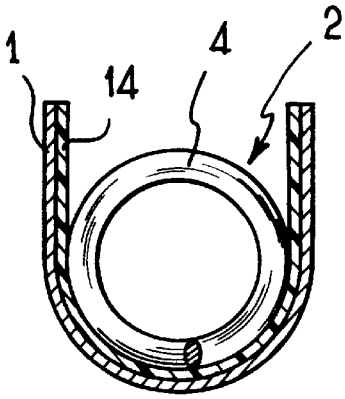
FIG. 4 is a fragmentary cross-section view of a variant of the second embodiment.

For longer transfer distances and as shown in the variant of FIG. 4, it is possible to cover the inside surface of the tubular case 1 at least in part with a friction lining 14 against which the helical portion 4 can rub while it is in operation. The friction lining 14 is preferably located facing the middle of the helical portion which is the zone of the helical portion that sags the most if it does indeed sag. The friction lining 14 is advantageously made of an insulating material such as polytetrafluoroethylene, thereby serving both to provide a low coefficient of friction and to insulate the helical portion 4 electrically from the tubular case 1 which can then be made out of a conductive material. The material used could also be a ceramic or mica. Advantageously, and in order to limit the wear due to friction against the friction lining, the flat strip forming the helical portion 4 is of rounded section, so as to avoid having any sharp edges, e.g. it is oval in section.

Figure 5:
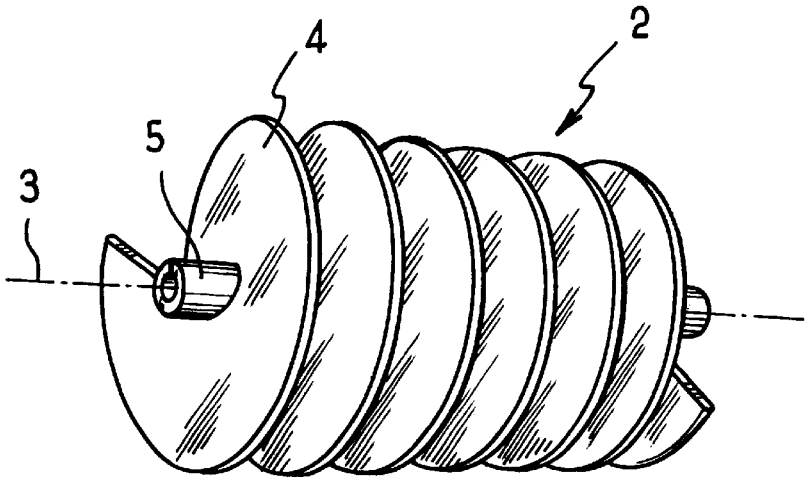
FIG. 5 is a perspective view of the transfer member of apparatus constituting a third embodiment.

In FIG. 5, the transfer member of the apparatus constituting a third embodiment comprises a tubular shaft 5 whose axis is the longitudinal axis 3. A helix 4 of the Archimedes' screw type is wound around the tubular shaft 5.

The tubular shaft 5 and the helix 4 are made as a single piece of electrically conductive material, in this case stainless steel. The helix 4 could also be fitted onto the shaft 5.

As before, the transfer member 2 is for mounting to rotate inside a tubular case, preferably a case made of electrically insulating material, via bearings that receive the ends of the tubular shaft 5, and it is designed to be connected via collector means such as drums having carbon brushes rubbing thereagainst, associated with an electricity power supply.

The cross-sectional area of the tubular shaft 5 is designed to be smaller than that of the cross-sectional area of the helix 4 (which is rectangular in this case) so that the current delivered to one end of the shaft 5 passes preferentially through the bulk of the helix 4. Any other means for increasing the resistance of the shaft compared to that of the helix could naturally be employed.

Figure 6:
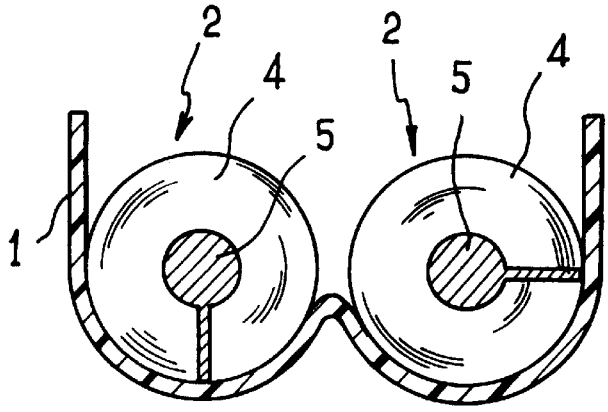
FIG. 6 is a cross-section view of a variant of the third embodiment.

In a variant, as shown in FIG. 6, it is possible to use two transfer members 2 disposed side by side in a common tubular case 1 defining two troughs. This makes it possible to increase the heat exchange areas quite considerably for a given transfer length. In this case, the transfer members 2 are spaced apart from each other, but in a variant they could be interleaved. In this case, the shafts 5 are shown as being solid, however they could naturally be tubular. The transfer members 2 are electrically connected to each other so that the electricity, flows along both members.

Naturally, the invention is not limited to the embodiments described and variants can be applied thereto without going beyond the ambit of the invention as defined by the claims.

In particular, a friction lining can be provided in any of the above-described embodiments, said lining extending over or all part of the tubular case.

What is claimed is:

1. Apparatus for transferring and heat-treating divided solids, the apparatus comprising at least one transfer member (2) having a longitudinal axis (3) and a helical portion (4) mounted to rotate about its own longitudinal axis inside a tubular case (1) and connected to the outlet shaft of a rotary drive motor, the apparatus further comprising heater means for heat-treatment, and wherein at least the helical portion (4) of the transfer member (2) is constituted in its bulk by an electrically conductive material, and wherein the transfer member (2) has connection means (11) for connecting it to an electricity power supply so that it itself constitutes the heater means.

2. Apparatus according to claim 1, wherein the helical portion (4) of the transfer member (2) comprises a helically-wound flat strip.

3. Apparatus according to claim 2, wherein the flat strip (4) is of rounded cross-section.

4. Apparatus according to claim 2, wherein the helical portion is constituted by a helix (4) wound around a shaft (5).

5. Apparatus according to claim 4, wherein the shaft (5) is made of an electrically insulating material.

6. Apparatus according to claim 4, wherein the shaft (5) is formed, at least on its outer surface, by a material that is electrically conductive.

7. Apparatus according to claim 1, wherein the electrically conductive material is a material such as stainless steel.

8. Apparatus according to claim 1, wherein the tubular case (1) is constituted by an electrically insulating material.

9. Apparatus according to claim 1, wherein the tubular case (1) is covered at least in part by an internal friction lining (14) of insulating material against which the helical portion (4) bears.

10. Apparatus according to claim 1,including it includes a coupling joint (13) of electrically insulating material connecting the transfer member (2) to the outlet shaft of the motor (12).

* * * * *

UNITED STATES PATENT AND TRADEMARK OFFICE

CERTIFICATE OF CORRECTION

PATENT NO. : 6,375,345 B1 
DATED : April 23, 2002
INVENTOR(S) : Olivier Lepez and Phillippe Sajet It is certified that error appears in the above-identified patent and that said Letters Patent is hereby corrected as shown below:

Title page,
Item [73], the Assignee's name is -- E.T.I.A. Evaluation Technologique Ingenierie et Applications -- instead of "E.T.T.A. Evaluation Technologique Ingenierie et Applications."

Signed and Sealed this

Third day of September, 2002

*Attest:*

*Attesting Officer*

JAMES E. ROGAN
*Director of the United States Patent and Trademark Office*